US008173587B2

(12) United States Patent
Preuschen

(10) Patent No.: US 8,173,587 B2
(45) Date of Patent: May 8, 2012

(54) DETERGENT COMPOSITION

(75) Inventor: Judith Preuschen, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 186 days.

(21) Appl. No.: 12/375,771

(22) PCT Filed: Aug. 3, 2007

(86) PCT No.: PCT/GB2007/002943

§ 371 (c)(1),
(2), (4) Date: Jan. 30, 2009

(87) PCT Pub. No.: WO2008/015443

PCT Pub. Date: Feb. 7, 2008

(65) Prior Publication Data

US 2009/0325840 A1 Dec. 31, 2009

(30) Foreign Application Priority Data

Aug. 4, 2006 (GB) ..... 0615487.6

(51) Int. Cl.

| | |
|---|---|
| ***C11D 3/20*** | (2006.01) |
| ***C11D 3/26*** | (2006.01) |
| ***C11D 3/39*** | (2006.01) |
| ***C11D 3/395*** | (2006.01) |

(52) U.S. Cl. ..... 510/224; 510/220; 510/221; 510/373; 510/375; 510/378; 510/499; 510/505; 252/186.27; 252/186.43

(58) Field of Classification Search ..... 510/238, 510/372, 375, 378, 499, 505, 220, 221, 224; 252/186.27, 186.43; 134/25.2
See application file for complete search history.

(56) References Cited

U.S. PATENT DOCUMENTS

| | | | | |
|---|---|---|---|---|
| 3,822,114 | A | 7/1974 | Montgomery | |
| 6,521,178 | B1 * | 2/2003 | Goldstein et al. | 422/21 |
| 2002/0122775 | A1 | 9/2002 | Reinhardt et al. | |
| 2003/0220214 | A1 * | 11/2003 | Ofosu-Asante et al. | 510/218 |

FOREIGN PATENT DOCUMENTS

| | | | |
|---|---|---|---|
| EP | 0677576 | A2 | 10/1995 |
| EP | 0787482 | A1 | 8/1997 |
| EP | 1209221 | A1 | 5/2002 |
| WO | 9426860 | A1 | 5/1994 |
| WO | 9426859 | A1 | 11/1994 |
| WO | 9501416 | A1 | 1/1995 |
| WO | 95/12656 | A | 5/1995 |
| WO | 95/21236 | A1 | 8/1995 |
| WO | 96/05283 | A1 | 2/1996 |
| WO | 03/106611 | A | 12/2003 |
| WO | 2005090541 | A1 | 9/2005 |

OTHER PUBLICATIONS

Dioxiranes: A New Class of Powerful Oxidants, Adam Waldemar et al., Acc. Chem. Res., 1989, vol. 22, pp. 205-211.
Encyclopedia of Chemical Technology, Surfactants and Detersive Systems, vol. 22, pp. 360-379, (1996).
Amines Derived from 3, 3-Diphenyl-2-Butanone and 2, 2-Diphenylcyclohexanone, Harold E. Zaugg, Freifelder, and Horrom, Contribution from the Organic Research Department, Abbott Laboratories, May 5, 1950, pp. 1191-1196.
The Reaction of α-Dimethylaminoacids with Acetic Anhydride, John A. King and McMillan, Contribution from the Warner Institute for Therapeutic Research, Sep. 1951, pp. 4451-4453.
5, 5-Dialkylhydantoins Containing a Dialkylamino Substituent, J. Wm. Magee and Henze, Contribution No. 135 from the Department of Chemistry, the University of Texas, vol. 60, Sep. 1938, pp. 2148-2151.
Polymer Surfactants, Novel Agents with Exceptional Properties, J. Storsberg et al., (1986).
Basic Esters and Amides of α-Substituted Diphenylacetic Acids, Harold E. Zaugg and Horrom, Contribution from the Department of Organic Chemistry, The Abbott Research Laboratories, vol. 72, Jul. 1950, pp. 3004-3007.
Surfactants, Kirk-Othmer Encyclopedia of Chemical Technology, Arza Seidel, Editor, 5th Ed., vol. 24, pp. 119-161, (1996).
English Language Abstract for EP1209221 taken from esp@cenet.com, (May 2002).
R Stoermer et al, Chemischen Berichte, 28, 1895, 2220-2227.
English Language Translation for R. Stoermer and W. Pogge: Disubstituted Amidoacetones, 1895, pp. 2220-2227.
R Stoermer et al, Chemischen Berichte, 29, 1896, 866-874.
English Language Translation for R. Stoermer et al, The Platimum Double Salt, 1896, pp. 866-874.

* cited by examiner

*Primary Examiner* — Gregory Delcotto
(74) *Attorney, Agent, or Firm* — Norris McLaughlin & Marcus PA

(57) ABSTRACT

A hard surface detergent composition is provided, said composition comprising a peroxygen bleach capable of exhibiting bleaching properties at a pH of below 9, and an amino ketone or derivative thereof bleach activator, and wherein a 1% wt solution in distilled water at 25° C. of the composition has a pH lower than 9. Potassium monopersulphate is the preferred bleach compound and diethyl amino acetone or derivative thereof is the preferred bleach activator. The compositions exhibit good bleaching performance at pHs of less than 9.

14 Claims, No Drawings

DETERGENT COMPOSITION

This is an application filed under 35 USC 371 of PCT/GB2007/002943.

TECHNICAL FIELD

The present invention relates to detergent compositions comprising a bleach and a bleach activator. In particular the present invention relates to hard surface cleaners comprising a bleach and bleach activator which together are effective at pHs of 9 or less.

BACKGROUND AND PRIOR ART

Generally many hard surface detergent compositions, and in particular automatic dishwashing detergent compositions, have an alkaline pH, usually in the range of from 9 to 12. It is well known to use a bleach system in such compositions in order to remove bleachable stains such as tea and tomato. For example automatic dishwashing detergent compositions comprising a peroxygen bleaching compound and a bleach activator are disclosed in EP-A-677576. Typical bleach systems used in such compositions include chlorine based bleaches and peroxygen bleaches, the latter being usually used with a bleach activator. Examples of the latter type of bleach system include percarbonate or perborate bleaches used with a bleach activator which is typically TAED. Indeed these two bleach/activator systems are the ones typically used in current detergent compositions.

However, if the pH of the composition is lowered to a more neutral pH, such as pH 7 or 8, the currently used standard chlorine or peroxygen bleaches are no longer effective. Their activation is kinetically hindered at these lower pHs and the oxidation processes thus proceed more slowly with the result that in order to provide the required bleaching effect several hours or even days is required instead of minutes which is the case at pHs of 9 and above. It has been suggested to use N-acyl and O-acyl bleach activator compounds to generate peroxy acids in aqueous acidic environments for bleaching properties in hard surface cleaners (see WO95/21236). It has also been suggested to use a pH adjustment system in automatic dishwashing compositions to obtain compositions which have an end pH of less than 10 (see WO95/12656 and WO 96/05283).

In some instances however it is desirable to formulate hard surface cleaners, and especially automatic dishwashing detergents, at lower pHs. This may apply for example where the detergent compositions are to comprise ingredients which are at least partially unstable at higher pHs, where it is desired to provide detergents which are less irritating to skin and eyes or where a lower pH composition is desired for some other reason.

To improve the bleach performance at pHs lower than 9, and especially at neutral pHs such as 7, an oxygen based bleach which is effective at this lower pH can be used. Monopersulphate salts, such as potassium peroxymonopersulphate (hereinafter KMPS) is one such peroxygen bleach which can be used.

However, even KMPS requires the use of a bleach activator in order to increase its activity to a level whereby acceptable bleaching is achieved at the required temperatures and in the required time.

KMPS has found use as a bleaching agent in denture care applications as disclosed in EP-A-787 482 where KMPS is used with TAED as an activator. The example in EP-A-787 482 comprises 20% wt KMPS, 3% wt sodium percarbonate and 1% wt TAED and requires an overnight reaction time in order to obtain excellent bleaching effects. Thus, the combination of KMPS and TAED is not suitable for low temperature bleaching where the reaction times have to be relatively short as is the case with hard surface cleaners, and especially so for automatic dishwashing compositions.

Other known activators for KMPS include ketones. It is known that the simplest ketone available, acetone, acts as an activator for KMPS; see W. Adam: Dioxiranes, "A new class of powerful oxidants", JACS, 1989, p. 205 wherein it is disclosed that dioxirane is the intermediate, highly active, molecule which can be used for oxidising (bleaching) stains, food residues and the like. However, acetone is generally not desired as an ingredient of hard surface cleaners, and especially automatic dishwashing compositions as it presents a fire/explosion hazard and has an overpowering and distinctive smell which is very difficult to disguise.

Additional ketone activators for peroxygen bleaches, including KMPS, are disclosed in U.S. Pat. No. 3,822,114. Fabric and hard surface bleaching at pH 10 or above is disclosed.

EP 1 209 221 discloses certain cyclic sugar ketones for use as bleach activators, especially for use with peroxygen bleaches such as KMPS in compositions at pH 9 and 10. However, these bleach activators have been found to exhibit reaction times with the aforementioned bleaches of several hours and this is unacceptable or undesirable for hard surface cleaning detergent compositions. The bleach systems disclosed in EP 1 209 221 are only effective at pH 10 and above.

However, a disadvantage which exists with the prior art bleaching systems of monopersulphate salts and the disclosed ketone bleach activators is that their bleaching performance is not fully satisfactory as it either proceeds too slowly and/or is not effective enough and/or it is not effective at pHs of 9 or below.

It is an object of the present invention to address one or more of the above-mentioned problems. In particular, it is an object of the present invention to provide safe, reliable hard surface detergent compositions which exhibit effective removal or reduction of bleachable stains yet which have a pH of below pH 9, and furthermore which preferably do so in reaction times of less than 10 hours. It is a further object of the present invention to provide hard surface detergent compositions which exhibit good bleaching properties (in terms of efficacy and speed) at pH 6 to 8. It is still a further object of the present invention to provide such detergent compositions which provide based on either an aqueous system or one comprising an organic solvent solution. Most detergents are aqueous based systems and these require a buffering system to maintain the pH within the ranges of the present invention.

STATEMENT OF INVENTION

According to the present invention there is provided a hard surface detergent composition comprising;

a) a peroxygen bleach capable of exhibiting bleaching properties at a pH of below 9, and b) an amino ketone or derivative thereof bleach activator, and wherein a 1% wt solution in distilled water at 25° C. of said composition has a pH of below 9.

It is preferred that the detergent composition is a dishwashing detergent composition, especially an automatic dishwashing composition. Preferably the hard surface detergent compositions comprise 1% wt to 20% wt of the peroxygen bleach.

According to a second embodiment there is provided the use of an amino ketone or derivative thereof bleach activator and a source of multivalent ions to improve the bleaching performance of a peroxygen bleach.

It is preferred that the peroxygen bleach is capable of exhibiting bleaching properties at a pH in the range of from 6.5 to 8.5.

The hard surface detergent compositions preferably comprise the amino ketone or derivative thereof bleach activator in an amount of from 0.01 to 10% wt.

For both embodiments the preferred peroxygen bleach is persulphate, with the sodium or potassium salt thereof being most preferred and potassium monopersulphate being especially preferred. Dialkyl amino acetones are the most preferred bleach activators with preferred types being those having two independently C1-C5 alkyl chains diethyl amino acetone being especially preferred, and their hydrochloride derivatives (salts) being especially preferred.

It is further preferred that the compositions of the invention further comprises a source of multivalent ions and especially those chosen from multivalent ion compounds of sulphates, carbonates, acetates, gluconates and metal-protein compounds, or zinc, bismuth or manganese.

Furthermore it is preferred that the detergent composition of the present invention comprises a pH buffering system. It is also preferred that the detergent composition has a pH in the range of from 6.5 to 8.5 as a 1% wt solution in demineralised water at 25° C.

Surprisingly, it has been found that compositions according to the invention exhibit good bleaching performance in compositions having a pH of 9 or below. The absolute bleaching power is found to be acceptable as is the reaction time required to obtain the desired bleaching effect. Furthermore, the compositions of the invention do not suffer unacceptably with other disadvantages associated with the prior art, such as, presenting a fire/explosion hazard or an unacceptable odour to the detergent compositions.

It has further surprisingly been found that the hard surface detergent compositions of the invention show particularly good bleaching properties when they additionally comprise a source of multivalent ions. This is especially surprising as it is well known that bleaching performance is usually adversely affected by the presence of multivalent ions.

Unless stated otherwise, all amounts herein are given as the percentage by weight of active ingredient based upon the weight of the total composition.

The term 'hard surface detergent compositions' as used herein means detergent compositions used for cleaning hard surfaces. Examples of hard surfaces include, but are not limited to, floors, walls, surfaces, windows, and household wares in particular kitchenware such as plates, dishes and cutlery etc. Detergent compositions for use on soft surfaces such as laundry detergents and other compositions to be used on fabrics etc are not included within the term 'hard surface detergent compositions'.

The term 'capable of exhibiting bleaching properties at a pH of below 9' as used herein means that the peroxygen bleach shows a result of at least 5 based on a grading of 1 to 10 (1 being no stain removal, 10 being complete removal) when tested in a Miele 651 dishwashing machine using a 50° C. normal cycle according to the IKW (Industrieverband für Körper-und Waschpflege based in Frankfurt, Germany) method for bleaching of stained tea cups as published on SOFW-Journal, 132, 3-2006, pages 55-70.

DETAILED DESCRIPTION

The present invention will now be described in further detail.

The hard surface detergent compositions according to the invention may be formulated as any type of such detergents, for example dishwashing detergents, floor cleaners or surface cleaners. An especially preferred type of detergent compositions according to the present invention is automatic dishwashing detergents.

The detergent composition may be aqueous based or solvent based depending upon the application it is intended for. Whether water is present in the composition will depend upon the intended use of the detergent composition and the product format.

A 1% wt solution of the detergent composition in distilled water has a pH at 25° C. of less than 9, preferably in the range of from 6.0 to 8.9, more preferably 6.5 to 8.5, especially 6.8 to 8.2, such as 7.0 to 8.0.

a) Detergent Composition Format

The detergent compositions of the present invention may be of any suitable form, including paste, liquid, solid (such as tablets, powder/granules) or gel with powders and tablets being preferred. When the composition is an automatic dishwashing product, it is preferably in the form of a unit dose product, i.e. a form which is designed to be used as a single portion of detergent composition in a washing operation. Of course, one or more of such single portions may be used in a cleaning operation.

Solid forms include, for example, in the form of a tablet, rod, ball or lozenge. The composition may be a particulate form, loose or pressed to shape or may be formed by injection moulding or by casting or by extrusion. The composition may be encased in a water soluble wrapping, for, example of PVOH or a cellulosic material. The solid product may be provided as a portioned product as desired.

The composition may also be in paste, gel or liquid form, including unit dose (portioned products) products. Examples include a paste, gel or liquid product at least partially surrounded by a water-soluble package, such as a polyvinyl alcohol package. This package may for instance take the form of a capsule, a pouch etc. Preferably the composition is substantially surrounded by such a package, most preferably totally surrounded by such a package. Any such package may contain one or more product formats as referred to herein.

b) Bleaching Compound

A bleaching compound is present in the compositions of the invention, the bleaching compound being capable of exhibiting bleaching properties at a pH of below 9, preferably in the range of from 6.0 to 8.9, more preferably 6.5 to 8.5, especially 6.8 to 8.2, such as 7.0 to 8.0. The bleaching compound may exhibit these bleaching properties either alone and/or in the presence of the amino ketone bleach activator.

Most preferably the bleach is selected from inorganic peroxides or organic peracids and the derivatives of either (including salts) which are capable of exhibiting bleaching properties at a pH of below 9. Examples of suitable inorganic peroxides include persulphates and these are especially preferred with the sodium and potassium peroxymonopersulphates, especially the potassium salt being the most preferred type of bleach according to the invention. The inorganic peroxides are normally alkali metal salts, such as lithium, sodium or potassium salts, in particular sodium or potassium salts. Perborates and/or or percarbonates may be used but are less favoured as they have been found to be less effective than the persulphates. However, it is possible according to the invention to use a mixture of bleaching compounds e.g. peroxymonopersulphates and/or perborates and/or percarbonates. The weight ratio of peroxymonopersulphates to the total amount of perborates and/or percarbonates is preferably in the range of from 10:1 to 1:10, preferably 5:1 to 1:2.

Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

The bleach component is preferably present in the detergent compositions in an amount of from 0.5% wt to 30% wt, more preferably 0.75% wt to 25 wt %, more preferably 1% wt to 20% wt, such as 1.5% wt to 15% wt.

c) Bleach Activator

The detergent compositions according to the invention comprise an amino acetone, or derivative thereof, bleach activator. Derivatives thereof include salts of the amino acetone. For the avoidance of doubt, the term 'amino acetone bleach activator' as used herein includes amino acetones and their derivatives, including salts, having bleach activator properties. Preferred bleach activators are dialkyl amino acetones and most preferred are those having two independently $C_1$-$C_{22}$ alkyl chains, $C_2$-$C_{22}$ alkenyl chains or phenyl or $C_5$-$C_8$ cycloalkyl chains, especially two independently $C_1$-$C_5$ alkyl chains, such as two independently $C_1$-$C_3$ alkyl chains. Diethyl amino acetone is an especially preferred bleach activator. According to a particular embodiment of the present invention, a bleaching system comprising KMPS and diethyl amino acetone is provided and has been found to be particularly advantageous.

Synthesis of the aforementioned amino acetones is described by R. Stoermer et al., Chem. Ber., 28, 1895, 2220-2227 and in Chem. Ber., 29, 1896, 866-874, by J. Magge und H. Henze, J. Amer. Chem. Soc., 60, 1938, 2148-2151, by J. King und McMillan, J. Amer. Chem. Soc., 73, 1951, 4451-4453 and by H. Zaugg und B. Horrom, J. Amer. Chem. Soc., 72, 1950, 3004-3007. The synthesis is normally carried out via reaction of a di-alkylamine with a mono-halogen acetone in a solvent. The formation of salts can be achieved via the reaction of amino acetones with an inorganic or organic acid. Preferred acids are hydrochloric acid, sulphuric acid, p-Toluonesulphonic acid, acetic acid, benzoic acid and polycarboxylic acids. Hydrochloride derivatives are especially preferred and diaminoacetone hydrochloride is most preferred.

Whilst any suitable amino acetone bleach activator can be used, the most preferred amino acetones for use as bleach activators according to the present invention, include; N,N-dimethylaminoacetone, N,N-diethylaminoacetone, N,N-dipropylaminoacetone, N,N-dibutylaminoacetone and N,N-diisobutylaminoacetone, piperidylacetone, 1-morpholin-4-yl-acetone and their salts including N,N-dimethylaminoacetone-hydrochloride, N,N-diethylaminoacetone-hydrochloride, N,N-diethylaminoacetone-hydrogensulphate, N,N-diethylaminoacetone-acetate, N,N-diethylaminoacetone-polycarboxylate, N,N-dipropy-lamino-acetone-hydrochloride, N,N-di-n-butylaminoacetone-hydrochloride, N,N-diisobutyl-aminoacetone-hydrochloride, piperidyl-acetone-hydrochloride, and 1-morpholin-4-yl-acetone-hydrochloride.

The amino acetones and their salts can be used with or without a carrier system according to the present invention.

Where a carrier system is used for the amino acetone, any conventional system may be employed. For example, a carrier system may comprise one or more of; silicates, aluminosilicates, carbonates, phosphates, sulphates and organic compounds such as citric acid and salts thereof.

Aluminosilicates are crystalline or amorphous silicates of aluminium, magnesium, calcium, potassium or sodium. Examples of aluminosilicates include clays such as kaolin, talkum, pyrophyllite, attapulgite, sepiolite, saponite, hectorite, smectite such as montmorillionite and especially bentonite, bauxite and zeolite. When a zeolite is used it is preferred that it is of type A or P. Especially preferred carriers for the amino acetone are bentonites known as Copisil® S 401, Copisil® N 401, Laundrosil® DGA, Laundrosil® EX 0242, Copisil® S 401, Copisil® N 401 or Ikomont® CA available from Südchemie, Germany.

Furthermore layered silicates can also be used, for example the commercially available products SKS-6 and Nabion 15 available from Clariant, Germany. These layered silicates can also be used as acidically modified products commercially available as Tonsil® EX 519, Tonsil Optimum 210 FF, Tonsil Standard 310 FF and 314 FF and Opazil® SO available from Südchemie, Germany.

It has been found that the amino acetone bleach activators with Copisil materials as the carrier system exhibit very good activation properties for bleaching compounds which are effective at pHs of below 9 and thus a mixture comprising the amino acetone bleach activator and a bentonite carrier system are especially preferred.

Other preferred carrier systems include sodium- or potassium sulphates, sodium carbonate, sodium hydrogen carbonates and alkali phosphates. Examples of phosphate carrier compounds include tri-sodium phosphate, tetra-sodium-diphosphate, di-sodium-dihydrogen-diphosphate, penta-sodium triphosphate, sodium-hexametaphosphate and oligomerers of tri-sodium-phosphate.

Organic carrier systems can include citric acid and sodium salts thereof, nitrilotriacetate (NTA) and ethylene-diamine-tetraacetic acid (EDTA). Additionally salts of homopolymers and copolymers of poly-acrylates and polymethyacrylates can be used. The relative molecular weight of those polymers is preferably between 1000 and 100,000.

When the amino acetone is used in the compositions if the invention in a form with a carrier system e.g. a powder, granulate or other mixture, the resulting mixture typically comprises an amount of from 20 to 98 wt % of the carrier system with the remaining being the amino acetone bleach activator. It is preferred that the mixture comprises from 30 to 95 wt % of the carrier system, especially from 40 to 90 wt % of the carrier system. Thus the amount of amino acetone bleach activator in the mixture preferably comprises from 2 to 80% wt, more preferably from 5 to 70% wt, especially from 10 to 60% wt. The amounts herein refer to the amounts in the amino acetone (salts)/carrier system mixture as used in the hard surface detergent compositions of the invention.

The amino acetone bleach activator may be mixed with the carrier system by any suitable method to produce of mixture of these two compounds. The preferred process for mixing the amino acetone bleach activator with the powdered carrier system is to use a mixer, for example a granulator, where the powdered carrier system is simply mixed with an aqueous solution of the amino acetones or their salts. The amount of carrier system used will depend upon the concentration of the amino acetone solution, the type of carrier system and on the processing parameters. It is well within the knowledge of the person skilled in the art to select a suitable amount of carrier system to be used in any given situation.

When a granulation process is used to produce the amino acetone bleach activator/carrier system mixture, it is typically followed by a drying step which may be by any conventional method such as by spray drying or by heating in a conventional oven. The amount of the amino acetone (salts) and carrier system in the mixture after any drying is that as stated hereinabove.

Extrusion is another possible process to manufacture the amino acetone bleach activator/carrier system mixture. Again, suitable methods are known to those in the art and this does not need further explanation here.

When the amino acetone bleach activators are used as a mixture with a carrier system, it has been found that the physical and/or chemical stability of the bleach activators is improved. This is the case for the stability of the bleach activator per se and when it is included in hard surface compositions which may also contain organic and/or inorganic peroxygen components.

The amino acetone bleach activators, and their salts, is preferably used in the hard surface detergent compositions of the invention in amounts of from 0.01 to 10 wt %, more preferred of from 0.1 to 8 wt % and most preferred of from 0.5 to 5 wt %. This refers to the amount of the bleach activator itself and not to the total amount of any mixture with a carrier system.

It is preferred that where the mixture of the amino acetone bleach activator and the carrier system is used in a solid form, e.g. powder or granulate, the weight average particle size lies in the range of from 50 to 2000 μm, more preferably of from 150 to 1800 μm, such as of from 300 to 1500 μm. Sieving may be used to provide a mixture having the desired particle size.

Also, according to one embodiment of the invention, the salts of the amino acetones may be synthesized by spraying in-situ a suitable amount of an amino acetone onto an acidic or partially neutralised carrier substance such as a polyacrylic acid.

These activators have been found to provide very effective bleaching effects upon bleachable stains in acceptable reaction times, typically in less than 1 hour.

d) pH Buffering System.

The detergent composition according to the invention may comprise a buffering system to maintain the pH of the composition at a pH below 9 on dissolution, especially when the detergent compositions are aqueous based.

The buffering system may comprise a source of acidity or a source of alkalinity to obtain the desired pH on dissolution. A source of acidity may suitably be any components which are acidic; for example polycarboxylic acids. Citric acid is especially preferred. Salts of these acids may also be used. A source of alkalinity may suitably be any suitable compound which is basic; for example any salt of a strong base and a weak acid such as soda. However additional acids or bases may be present. In the case of alkaline compositions silicates, phosphates or hydrogen phosphates may suitably be used. Preferred silicates are sodium silicates such as sodium disilicate, sodium metasilicate and crystalline phyllosilicates.

According to the present invention, the detergent compositions have a pH of below 9, preferably in the range of from 6.0 to 8.9, more preferably 6.5 to 8.5, especially 6.8 to 8.2, such as 7.0 to 8.0. The pH of the detergent composition is expressed as the pH of a 1% wt solution in demineralised water at 25° C.

e) Other Optional Ingredients

It is known to include a source of multivalent ions in hard surface cleaning compositions, and in particular in automatic dishwashing compositions, for technical and/or performance reasons. For example, multivalent ions, especially multivalent cations, and most especially zinc and/or manganese ions have been included for their ability to inhibit corrosion on metal and/or glass. Bismuth ions may also have benefits when included in such compositions.

For example, organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$ and $Ce(NO_3)_3$. Zinc salts are specially preferred corrosion inhibitors.

Therefore, an especially preferred optional ingredient according to the present invention is a source of multivalent ions, especially cations, such as those mentioned in the immediately preceding paragraph and in particular zinc, bismuth and/or manganese ions. In particular a source of zinc ions is preferred. Any suitable source of multivalent cations may be used, with the source preferably being chosen from multivalent cation salts of sulphates, carbonates, acetates, gluconates and metal-protein compounds and those mentioned in the immediately preceding paragraph.

Surprisingly it has been found that bleaching performance is not adversely affected when a multivalent cation source is included in the detergent compositions of the invention, particularly when a zinc source is included. This was totally unexpected as the negative effect on bleaching performance which usually occurs in detergent compositions comprising a bleach compound and multivalent ions, especially zinc ions, has been at least to some extent addressed. Furthermore, it has also very surprisingly been found that an increase in bleaching performance can even be obtained by the inclusion of a multivalent cation source, especially a zinc ion source.

Any conventional amount of multivalent cations/multivalent cations source may be included in the compositions of the invention. However, it is preferred that the multivalent cations are present in an amount of from 0.01% wt to 5% wt, preferably 0.1% wt to 3% wt, such as 0.5% wt to 2.5% wt. The amount of multivalent cation source in the hard surface detergent compositions of the invention will thus be correspondingly higher.

The detergent compositions of the invention may contain surface active agents, for example, anionic, cationic, amphoteric or zwitterionic surface active agents or mixtures thereof. Many such surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred.

A preferred class of nonionic surfactants are ethoxylated non-ionic surfactants prepared by the reaction of a monohydroxy alkanol or alkylphenol with 6 to 20 carbon atoms. Preferably the surfactants have at least 12 moles particularly preferred at least 16 moles, and still more preferred at least 20 moles of ethylene oxide per mole of alcohol or alkylphenol.

Particularly preferred non-ionic surfactants are the non-ionics from a linear chain fatty alcohol with 16-20 carbon atoms and at least 12 moles particularly preferred at least 16 and still more preferred at least 20 moles of ethylene oxide per mole of alcohol.

According to one embodiment of the invention, the non-ionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units may be used. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_x[CH_2CH_2O]_y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

where $R^1$ and $R^2$ represent linear or branched chain, saturated or unsaturated, alyphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, alyphatic or aromatic hydrocarbon groups with 6-22 carbon atoms, where group with 8 to 18 carbon atoms are particularly preferred. For the group $R^3H$, methyl or ethyl are particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO) (EO) (PO), (EO)(EO)(EO), (PO) (EO) (PO), (PO)(PO)(EO) and (PO) (PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different nonionic surfactants is suitable in the context of the present invention for instances mixtures of alkoxylated alcohols and hydroxy group containing alkoxylated alcohols.

Other suitable surfactants are disclosed in WO 95/01416, to the contents of which express reference is hereby made.

Preferably the non-ionic surfactants are present in the compositions of the invention in an amount of from 0.1% wt to 5% wt, more preferably 0.5% wt to 3% wt, such as 0.5 to 3% wt.

The surface active agents are typically included in amounts of up to 15% wt, preferably of from 0.5% wt to 10% wt, such as 1% wt to 5% wt.

The detergent compositions may also comprise conventional amounts of detergent builders which may be either phosphorous based or non-phosphorous based, or even a combination of both types. Suitable builders are well known in the art.

If phosphorous builders are to be used in the hard surface cleaner compositions of the inventions then it is preferred that mono-phosphates, di-phosphates, tri-polyphosphates or oligomeric-polyphosphates are used. The alkali metal salts of these compounds are preferred, in particular the sodium salts. An especially preferred builder is sodium tripolyphosphate (STPP).

The non-phosphorous based builder may be organic molecules with carboxylic group(s), amino acid based compound or a succinate based compound. The term 'succinate based compound' and 'succinic acid based compound' are used interchangeably herein.

Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred builder is sodium citrate.

Preferred examples of amino acid based compounds according to the invention are MGDA (methyl-glycine-diacetic acid, and salts and derivatives thereof) and GLDA (glutamic-N,N-diacetic acid and salts and derivatives thereof). GLDA (salts and derivatives thereof) is especially preferred according to the invention, with the tetrasodium salt thereof being especially preferred. Other suitable builders are described in U.S. Pat. No. 6,426,229 which is incorporated by reference herein. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula;

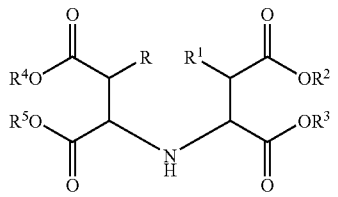

in which R, $R^1$, independently of one another, denote H or OH, $R^2$, $R^3$, $R^4$, $R^5$, independently of one another, denote a cation, hydrogen, alkali metal ions and ammonium ions, ammonium ions having the general formula $R^6R^7R^8R^9N+$ and $R^6$, $R^7$, $R^8$, $R^9$, independently of one another, denoting hydrogen, alkyl radicals having 1 to 12 C atoms or hydroxyl-substituted alkyl radicals having 2 to 3 C atoms. A preferred example is tetrasodium imminosuccinate.

Preferably the total amount of builder present in the compositions is an amount of at least 5 wt %, preferably at least 10 wt %, more preferably at least 20 wt %, and most preferably at least 25 wt %, preferably in an amount of up to 70 wt %, preferably up to 65 wt %, more preferably up to 60 wt %, and most preferably up to 35 wt %. The actual amount used will depend upon the nature of the builder used.

The detergent compositions of the invention may further comprise a secondary builder (or cobuilder). Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts is the sodium salts.

Secondary builders which are organic are preferred.

Suitable polycarboxylic acids are acyclic, alicyclic, heterocyclic and aromatic carboxylic acids, in which case they contain at least two carboxyl groups which are in each case separated from one another by, preferably, no more than two carbon atoms.

Polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid.

Another suitable polycarboxylic acid is the homopolymer of acrylic acid. Other suitable builders are disclosed in WO 95/01416, to the contents of which express reference is hereby made.

The detergent composition according to the invention may also comprise one or more foam control agents. Suitable foam control agents for this purpose are all those conventionally used in this field, such as, for example, silicones and paraffin oil. The foam control agents are preferably present in the composition in amounts of 5% by weight or less of the total weight of the composition.

The detergent composition may also comprise a silver/copper corrosion inhibitor in conventional amounts and this is preferred when the composition is an automatic dishwashing detergent. This term encompasses agents that are intended to prevent or reduce the tarnishing of non-ferrous metals, in particular of silver and copper. Preferred silver/copper corrosion inhibitors are benzotriazole or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Other customary additives are, for example, dyes and perfumes and optionally in the case of liquid products, preservatives, suitable examples of which are compounds based on isothiazolinone. Thickeners may also be used in paste, liquid and gel products. Any suitable thickeners may be used with gums, polymers and gels being preferred. Polymers intended to improve the cleaning performance of the detergent compositions may also be included therein. For example sulphonated polymers may be used. Preferred examples include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, 2-hydroxy-3-(2-propenyloxy)propanesulfonic acid, 2-methyl-2-propenen-1-sulfonic acid, styrenesulfonic acid, vinylsulfonic acid, 3-sulfopropyl acrylate, 3-sulfopropylmethacrylate, sulfomethylacrylamide, sulfomethylmethacrylamide and water soluble salts thereof. Suitable sulfonated polymers are also described in U.S. Pat. No. 5,308,532 and in WO 2005/090541.

When a sulfonated polymer is present, it is preferably present in the composition in an amount of at least 0.1 wt %, preferably at least 0.5 wt %, more preferably at least 1 wt %, and most preferably at least 3 wt %, up to 40 wt %, preferably up to 25 wt %, more preferably up to 15 wt %, and most preferably up to 10 wt %.

If the hard surface cleaner is in the form of a shaped body or a tablet then a conventional amount of a binder material may be included. Any conventional binders may be used, typically in an amount of up to 10% wt, more preferably in an amount of up to 5% wt. Suitable binders include polyethylene glycols.

The detergent composition may comprise one or more enzymes. However, the enzymes are preferably chosen such that they are effective at the pH of the detergent composition. In some cases higher levels of enzymes than would be used conventionally may need to be included to compensate for them working outside of their optimal pH range.

It is preferred that the enzyme is selected from protease, lipase, amylase, cellulase and peroxidase enzymes. Such enzymes are commercially available and sold, for example, under the registered trade marks Esperase, Alcalase and Savinase by Nova Industries A/S and Maxatase by International Biosynthetics, Inc. It is most preferred that protease enzymes are included in the compositions according to the invention; such enzymes are effective for example in dishwashing detergent compositions.

Desirably enzyme(s) is/are present in the composition in an amount of from 0.01 to 3 wt %, especially 0.1 to 2.5 wt %, such as 0.2 to 2 wt %.

The detergent compositions of the invention may also comprise minor, conventional amounts of perfumes, preservatives and/or colourants. Such ingredients are typically present in amounts of up to 2% wt.

The compositions of the invention may be made by any suitable method depending upon their format. Manufacturing methods for detergent compositions are well known in the art and do not require further explanation here. For example, detergent tablets may be made by compacting granular/particular material.

The composition is described with reference to the following non-limiting Examples. Further examples within the scope of the invention will be apparent to the person skilled in the art.

EXAMPLES

Example 1

Comparative Hard Surface Cleaner Detergent Composition

Powdered detergent compositions were prepared according to the formulations given in Table 1 below. The compositions comprised the known peroxygen bleach monopersulfate and also the known cyclic sugar ketone bleach activator 1,2:4,5-Di-O-isopropylidene-D-erythro-2,3-hexodiuo-2,6-pyranose (IEHP).

TABLE 1

| Component | Wt % | | | |
|---|---|---|---|---|
| | 1A | 1B | 1C | 1D |
| Sodium Citrate | 74.8 | 73.8 | 69.8 | 68.8 |
| Citric acid | 2.0 | 2.0 | 2.0 | 2.0 |
| Soda | 0.0 | 0.0 | 0.0 | 0.0 |
| IEHP | 1.0 | 2.0 | 1.0 | 2.0 |
| Potassium monopersulphate | 10.0 | 10.0 | 15.0 | 15.0 |
| Amylase*[1] | 0.4 | 0.4 | 0.4 | 0.4 |
| Protease*[2] | 1.1 | 1.1 | 1.1 | 1.1 |
| Sulfonated polymer*[3] | 5.0 | 5.0 | 5.0 | 5.0 |
| PEG 6000 | 2.0 | 2.0 | 2.0 | 2.0 |
| PEG 1500 | 3.0 | 3.0 | 3.0 | 3.0 |
| Nonionic Surfactant*[4] | 0.5 | 0.5 | 0.5 | 0.5 |
| Benzotriazole (BTA) | 0.1 | 0.1 | 0.1 | 0.1 |
| Perfume | 0.1 | 0.1 | 0.1 | 0.1 |

*[1]Duramyl[RTM] available from Novozymes, Denmark.
*[2]Properase[RTM] ex Genencor International, USA.
*[3]Sulphonated polyacrylic acid copolymer Acusol[RTM] 587 available from Rohm and Haas.
*[4]C16-18 fatty alcohol 3EO-3PO Each separate composition was prepared by simply mixing all the ingredients together immediately prior to testing. The pH of the formulations was measured at 1 wt % in water at room temperature. Minor amounts of citric acid or soda were added in order to achieve the desired pH value of 7.5.

Example 2

Bleaching Capability of Comparative Formulation at pH 7.5

The bleach performance (and other cleaning performances) of the formulations in Table 1 was tested in a Miele 651 dishwashing machine using a 50° C. normal cycle containing tea cups stained with tea, according to the IKW method described above. 20 g of the powder formulation was added to the dosing chamber of the dishwasher prior to the cycle commencing. The water hardness was 21° gH.

The results of tea stain bleaching in tea cups obtained by the comparative compositions are given in Table 1. The bleaching effect is expressed on a scale of 1-10 (1 being little or no bleaching and 10 being total bleaching of the tea stain).

TABLE 2

| Example | pH of formulation | Tea Stain Removal |
|---|---|---|
| 1A | 7.5 | 2.9 |
| 1B | 7.5 | 2.9 |
| 1C | 7.5 | 3.0 |
| 1D | 7.5 | 3.0 |

The removal of tea stains from tea cups in the above test was insufficient even for the higher concentrations of bleach and bleach activator. The test time in the main wash cycle of the automatic dishwashing cycle (i.e. where the detergent is active) is 20 minutes.

Example 3

Compositions Comprising Diethyl-aminoacetone Bleach Activator

Detergent compositions according to the present invention were prepared according to the formulations given in Table 3 below and following the same method as outlined for example 1. The compositions comprised the known peroxygen bleach peroxymonopersulphate and also the diethyl amino acetone bleach activator according to the present invention.

TABLE 3

| Component | Wt % | | |
|---|---|---|---|
| | 3A | 3B | 3C |
| Sodium citrate | 73.8 | 71.3 | 68.8 |
| Citric acid | 2.0 | 2.0 | 2.0 |
| Soda | 0.0 | 0.0 | 0.0 |
| Diethyl amino acetone hydrochloride bleach activator | 2.0 | 2.0 | 2.0 |
| Potassium monopersulphate | 10.0 | 12.5 | 15.0 |
| Amylase*[1] | 0.4 | 0.4 | 0.4 |
| Protease*[2] | 1.1 | 1.1 | 1.1 |
| Sulfonated polymer*[3] | 5.0 | 5.0 | 5.0 |
| PEG 6000 | 2.0 | 2.0 | 2.0 |
| PEG 1500 | 3.0 | 3.0 | 3.0 |
| Nonionic Surfactant*[4] | 0.5 | 0.5 | 0.5 |
| BTA | 0.1 | 0.1 | 0.1 |
| Perfume | 0.1 | 0.1 | 0.1 |

The pH of the formulations was measured at 1 wt % in water at room temperature. Minor amounts of citric acid or soda were added in order to achieve the desired pH value of 7.5.

Example 4

Bleaching Capability of Detergent Composition of the Invention at pH 7.5

The bleach performance of the formulations in Table 3 was tested as for Example 1.

TABLE 4

| Example | pH of formulation | Tea Stain Removal |
|---|---|---|
| 3A | 7.5 | 3.5 |
| 3B | 7.5 | 6.2 |
| 3C | 7.5 | 8.2 |

The above results demonstrate that the hard surface cleaner compositions according to the present invention show good bleaching characteristics at pH 7 and this is achieved in an acceptable time (that is in the timing of a conventional automatic dishwashing cycle).

Example 5 pH-Dependency of Diethyl Amino Acetone Bleach Activator

The ability of diethyl amino acetone to act as a bleach activator over a range of pHs was investigated by using the compositions given in table 5 below and testing it according to the experimental regime described in Example 1. The compositions were prepared according to the method of example 1.

TABLE 5

| Component | % wt 5A | 5B | 5C | 5D |
|---|---|---|---|---|
| Sodium Citrate | 69.63 | 69.23 | 65.23 | 62.23 |
| Citric acid | 5.0 | 3.0 | 2.0 | 0.0 |
| Soda | 0.0 | 2.0 | 7.0 | 12.0 |
| Diethyl amino acetone hydrochloride bleach activator cogranulate*5 | 0.67 | 0.67 | 0.67 | 0.67 |
| Potassium monopersulphate | 12.5 | 12.5 | 12.5 | 12.5 |
| Amylase*1 | 0.4 | 0.4 | 0.4 | 0.4 |
| Protease*2 | 1.1 | 1.1 | 1.1 | 1.1 |
| Sulfonated polymer*3 | 5.0 | 5.0 | 5.0 | 5.0 |
| PEG 6000 | 2.0 | 2.0 | 2.0 | 2.0 |
| PEG 1500 | 3.0 | 3.0 | 3.0 | 3.0 |
| Nonionic Surfactant*4 | 0.5 | 0.5 | 0.5 | 0.5 |
| BTA | 0.1 | 0.1 | 0.1 | 0.1 |
| Perfume | 0.1 | 0.67 | 0.67 | 0.67 |

*5The diethyl amino acetone bleach activator was cogranulated with bentonite clay carrier in a 1:2 parts by weight mixture which is available as Copisil. The compositions contained 0.447% wt clay carrier and 0.223% wt diethyl amino acetone bleach activator.

TABLE 6 effect of pH on bleaching on tea stains.

| Example | pH of formulation | Tea Stain Removal |
|---|---|---|
| 5D | 7 | 5.0 |
| 5C | 8 | 4.0 |
| 5B | 9 | 3.0 |
| 5A | 10 | 3.0 |

The above results demonstrate that the diethyl amino acetone is effective as a bleach activator at pHs below 9. Furthermore, it shows that these activators are more effective at pH 7 and 8 than at pH 9 and above.

Example 6

Concentration Dependence of Diethyl Amino Acetone Bleach Activator

The effect of the concentration of diethyl amino acetone on bleaching performance at constant bleach concentration was investigated by using the composition given in table 7 below and testing it according to the experimental regime described in Example 1. The compositions were prepared following the method given for example 1. The pH of the compositions was 7. The results are given in table 8 below.

TABLE 7

| Component | Wt % 6A | 6B | 6C |
|---|---|---|---|
| Sodium Citrate | 69.63 | 69.26 | 68.3 |
| Citric acid | 5.0 | 5.0 | 5.0 |
| Soda | 0.0 | 0.0 | 0.0 |
| Diethyl amino acetone hydrochloride bleach activator*5 | 0.67 | 1.04 | 2.0 |
| Potassium monopersulphate | 12.5 | 12.5 | 12.5 |
| Amylase*1 | 0.4 | 0.4 | 0.4 |
| Protease*2 | 1.1 | 1.1 | 1.1 |
| Sulfonated polymer*3 | 5.0 | 5.0 | 5.0 |
| PEG 6000 | 2.0 | 2.0 | 2.0 |
| PEG 1500 | 3.0 | 3.0 | 3.0 |
| Nonionic Surfactant*4 | 0.5 | 0.5 | 0.5 |
| BTA | 0.1 | 0.1 | 0.1 |
| Perfume | 0.1 | 0.1 | 0.1 |

*5The diethyl amino acetone bleach activator was cogranulated with bentonite clay carrier as in Example 5. Example 6A contained 0.447% wt clay carrier and 0.223% wt diethyl amino acetone bleach activator. Example 6B contained 0.693% wt clay carrier and 0.347% wt diethyl amino acetone bleach activator. Example 6C contained 1.334% wt clay carrier and 0.666% wt diethyl amino acetone bleach activator.

TABLE 8

| Example | Tea Stain Removal |
|---|---|
| 6A | 5.0 |
| 6B | 7.5 |
| 6C | 8.0 |

The above results demonstrate that increasing the concentration of the diethyl amino acetone bleach activator results in an increase in bleaching effect for a constant concentration of KMPS. Furthermore, example 6C showed surprisingly high stability as no discoloration of the bleach activator granules or yellowing of the detergent composition was observed after 6 weeks storage at 30° C./70% RH.

Example 7

Addition of Zinc Salts

Zinc salts are often included in automatic dishwashing detergents to prevent or reduce glass corrosion. However, it is well known that zinc ions have a negative impact on oxygen based bleaches' performance which is obviously undesirable.

The composition of Table 7 was repeated but with the addition of 0.24% wt of zinc sulphate in place of the same amount of sodium citrate and the experimental regime and preparation method of experiment 1 was followed.

The tea removal improved to a score of 6.0 for the composition comprising zinc sulphate from 5.0 for the example in table 7 which did not comprise zinc. This was totally unexpected as the negative effect on bleaching performance usually found in detergent compositions comprising a bleach and zinc ions has been negated. Furthermore, it was highly surprising that not only was the good bleach performance was retained but an increase in bleaching performance was obtained.

Example 8

Phosphate Builder (STPP) Containing Detergent Composition

The detergent composition of Table 9 was prepared following the method of example 1. The pH of the compositions was measured to be 8 as previously described in the above examples.

TABLE 9

| Component | Wt % |
|---|---|
| STPP | 24 |
| Sodium citrate | 50 |
| Diethyl amino acetone | 2 |

TABLE 9-continued

| Component | Wt % |
|---|---|
| hydrochloride bleach activator*5 | |
| KMPS | 12.5 |
| Amylase*1 | 0.4 |
| Protease*2 | 1.1 |
| Sulfonated polymer*3 | 5.0 |
| PEG 6000 | 2.0 |
| PEG 1500 | 3.0 |
| Nonionic surfactant*4 | 0.5 |
| BTA | 0.1 |
| Perfume | 0.1 |

The detergent composition was prepared according to the method of example 1 tested according to the experimental regime there and a score of 5.0 was obtained. Thus an acceptable bleaching result is obtained according to the present invention regardless of the type of builder (phosphate or non-phosphate) used.

The invention claimed is:

1. A method of bleaching dishware within an automatic dishwasher comprising contacting said dishware with an automatic dishwasher detergent composition comprising an amino ketone or derivative thereof bleach activator, a source of multivalent ions, and a peroxygen bleach.

2. A method according to claim 1, wherein the peroxygen bleach is capable of exhibiting bleaching properties at a pH in the range of from 6.5 to 8.5.

3. A method according to claim 1, wherein the peroxygen bleach is a persulphate bleach.

4. A method according to claim 3, wherein the persulphate bleach is a sodium or potassium salt of the persulphate bleach.

5. A method according to claim 4, wherein the persulphate bleach is potassium monopersulphate.

6. A method according to claim 1, wherein the composition comprises the amino ketone or derivative thereof bleach activator in an amount of from 0.01 to 10 wt %.

7. A method according to claim 1, wherein the amino ketone or derivative thereof bleach activator is a dialkyl-amino acetone.

8. A composition method according to claim 7 wherein the dialkyl-amino acetone has two different $C_1$-$C_5$ alkyl chains.

9. A composition method according to claim 8, wherein the dialkyl-amino acetone is diethyl amino acetone.

10. A composition method according to claim 1 wherein the amino ketone derivative is a hydrochloride salt.

11. A composition method according to claim 1, wherein the multivalent cation is selected from the group consisting of zinc, bismuth or manganese.

12. A composition method according to claim 1, wherein the source of multivalent cations is chosen from the group consisting of compounds of sulphates, carbonates, acetates, gluconates and metal-protein compounds.

13. A composition method according to claim 1, wherein the detergent composition has a pH in the range of from 6.5 to 8.5 as a 1% wt solution in demineralised water at 25° C.

14. A composition method according to claim 1, where the detergent composition has a pH in the range of from 6.8 to 8.2 as a 1% wt solution in demineralised water at 25° C.

* * * * *